US011965287B2

(12) United States Patent
Mergenthaler et al.

(10) Patent No.: US 11,965,287 B2
(45) Date of Patent: Apr. 23, 2024

(54) COLORING OF A TEXTILE LAYER AND A TEXTILE LAYER

(71) Applicant: adidas AG, Herzogenaurach (DE)

(72) Inventors: Patrick Mergenthaler, Markt Bibart (DE); Bernd Barthelmess, Rosstal (DE); Stefan Egerer, Puschendorf (DE)

(73) Assignee: adidas AG, Herzogenaurach (DE)

( * ) Notice: Subject to any disclaimer, the term of this patent is extended or adjusted under 35 U.S.C. 154(b) by 825 days.

(21) Appl. No.: 17/070,820

(22) Filed: Oct. 14, 2020

(65) Prior Publication Data

US 2021/0115624 A1 Apr. 22, 2021

(30) Foreign Application Priority Data

Oct. 16, 2019 (DE) ..... 102019215939.7

(51) Int. Cl.

| | |
|---|---|
| ***D06N 3/14*** | (2006.01) |
| ***A43B 23/02*** | (2006.01) |
| ***A43D 63/00*** | (2006.01) |

(52) U.S. Cl.

CPC ..... *D06N 3/145* (2013.01); *A43B 23/0235* (2013.01); *A43D 63/00* (2013.01); *A43D 2200/10* (2013.01); *D06N 2203/068* (2013.01); *D06N 2209/0815* (2013.01); *D06N 2211/106* (2013.01)

(58) Field of Classification Search

None

See application file for complete search history.

(56) References Cited

U.S. PATENT DOCUMENTS 4,131,422 A * 12/1978 Thomas ..... D06P 1/5257 8/558
2021/0277595 A1* 9/2021 van den Berg ..... D06N 3/14

FOREIGN PATENT DOCUMENTS

| | | | |
|---|---|---|---|
| CN | 101381964 | A | 3/2009 |
| CN | 101608404 | A | 12/2009 |
| CN | 103703183 | A | 4/2014 |
| CN | 106868896 | A | 6/2017 |
| CN | 108978284 | A | 12/2018 |
| DE | 3148246 | A1 | 6/1983 |
| DE | 3750467 | | 10/1994 |
| DE | 10035746 | | 2/2002 |
| DE | 102012202866 | | 8/2013 |
| EP | 1337572 | | 1/2011 |
| EP | 2713794 | | 4/2017 |
| EP | 3388491 | | 10/2018 |

(Continued)

OTHER PUBLICATIONS

German Patent Application No. 102019215939.7, Office Action, dated Feb. 23, 2022, 6 pages.

(Continued)

*Primary Examiner* — Jeffrey D Washville

(74) *Attorney, Agent, or Firm* — Kilpatrick Townsend & Stockton LLP

(57) ABSTRACT

The present invention relates to a textile layer comprising a first coating, wherein the first coating is a cured coating and comprises a polyurethane. The textile layer further comprises a second coating, wherein the second coating comprises at least one coloring agent and is arranged on the cured first coating. The polyurethane based cured first coating is transparent.

20 Claims, 1 Drawing Sheet

(56) References Cited

FOREIGN PATENT DOCUMENTS

| | | |
|---|---|---|
| JP | H11-001878 A | 1/1999 |
| WO | 2006071678 | 7/2006 |

OTHER PUBLICATIONS

Office Action, Chinese Patent Application No. 202011101592.8, dated Dec. 26, 2022, 14 pages.
German Patent Application No. 102019215939.7, Office Action, dated May 14, 2020, 12 pages (English machine translation provided).
Decision of Rejection, Chinese Patent Application No. 202011101592.8, dated Jul. 1, 2023, 15 pages.
Chinese Patent Application No. 202011101592.8, Office Action, dated Sep. 15, 2022, 15 pages.

* cited by examiner

COLORING OF A TEXTILE LAYER AND A TEXTILE LAYER

CROSS REFERENCE TO RELATED APPLICATION

This application is related to and claims priority benefits from German Patent Application No. 102019215939.7, filed on Oct. 16, 2019, entitled COLORING OF A TEXTILE LAYER AND A TEXTILE LAYER ("the '939 application"). The '939 application is hereby incorporated herein in its entirety by this reference.

FIELD OF THE INVENTION

The present invention relates to a method of coloring a textile layer, in particular using a primer coating layer comprising a polyurethane. Moreover, the present invention relates to a textile layer.

BACKGROUND

An important element in printing on textiles is to achieve a good combination of color-brightness and ink-adhesiveness to the substrate. Usually there is a trade-off between both elements. It is on one hand possible to achieve a high brightness by keeping the ink at the top surface of the textile, with the risk of this ink being more easily worn away or accidently removed from the surface of the textile. Alternatively, it is possible to achieve a good bonding of the ink to the substrate by embedding the ink deep within the textile, however pigments in deeper layers of the substrate are often less bright or even less visible.

It would be beneficial to find an ink that could sit on the surface of a textile in order to provide a clear image with good color quality, that also adheres strongly to the fibers of the textile. In the absence of an ink of this sort, other mechanisms are being used to better adhere conventional inks to the surface of products.

In the automotive industry, it is beneficial to improve the adhesion of paints onto the surface of vehicles in order to withstand the external conditions that the vehicle is usually subject to. To overcome some of these issues, prior art document EP 133 75 72 B1 teaches in relation to car varnishing the usage of aqueous and physically curable polyurethane-based coating materials for use as a wash primer for coatings. This sort of 'adhesion primers' may be applied to untreated and uncoated plastic surfaces and then covered with a layer of varnish. A further benefit of the coating materials of EP 133 75 72 B1 is the ability to adhere permanently to a wide variety of old coatings and uncoated plastic surfaces and thereby allow for the possibility for re-varnishing.

Closer to the problem discussed above with relation to printing on textiles, EP 3 388 491 A1 relates to decoration of natural leather. The low viscosity of inkjet inks commonly used with leather allows the ink to penetrate easily into the leather leading to poor image quality. For improvement, EP 3 388 491 A1 teaches to use a base coat including a polymer or copolymer based on polyurethane. Furthermore, the base coat includes a polyamide polymer or copolymer, as polyamide has been found to improve the compatibility with the crust leather and to improve the strength of the base coat.

However, none of the conventional techniques known from the prior art are optimized for the improvement of coloring a textile layer. It is therefore the problem underlying the present invention to improve the quality of colored textiles and to provide methods to increase the quality of coloring textiles so that the above outlined disadvantages of the prior art are at least partly overcome.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some aspects, the present disclosure is directed to a method of coloring a textile layer comprising the steps of: applying a first coating to the textile layer, wherein the first coating comprises a polyurethane; curing the first coating, wherein the first coating is transparent after the curing; and applying a second coating to the cured first coating, wherein the second coating comprises at least one coloring agent. A thickness of the first coating may be between 20 and 120 μm after the curing, 40 and 110 μm after the curing, or between 80 and 95 μm after the curing. The curing may comprise applying heat to the textile layer at a temperature between 20° C. and 150° C., between 40° C. and 130° C., between 60° C. and 110° C. or between 80° C. and 100° C. The curing may comprise using an oven, a fan, a hot air blower, an infrared radiator or combinations thereof. The curing may further comprise applying the heat to the textile layer for less than 60 minutes. The applying the first and/or second coating may comprise applying the first and/or second coating using a spray gun, a silicon pad or an ink-jet. The method may further comprise adapting a rheology of the first coating depending on a material of the textile layer. The second coating may further comprise a polyurethane.

In some aspects, the present disclosure is directed to a textile layer comprising: a first coating, wherein the first coating is a cured coating and comprises a polyurethane; a second coating, wherein the second coating comprises at least one coloring agent and is arranged on the cured first coating; and wherein the polyurethane based cured first coating is transparent. A thickness of the first coating may be between 20 and 120 μm after the curing, between 40 and 110 μm after the curing, or between 80 and 95 μm after the curing. The first and/or second coating may be applied using a spray gun, a silicon pad or an ink-jet. A rheology of the first coating may be adapted depending on a material of the textile layer. The second coating may comprise a polyurethane.

BRIEF DESCRIPTION OF THE DRAWINGS

In the following detailed description, embodiments of the invention are described referring to the following figures.

BRIEF DESCRIPTION

Figure 1:
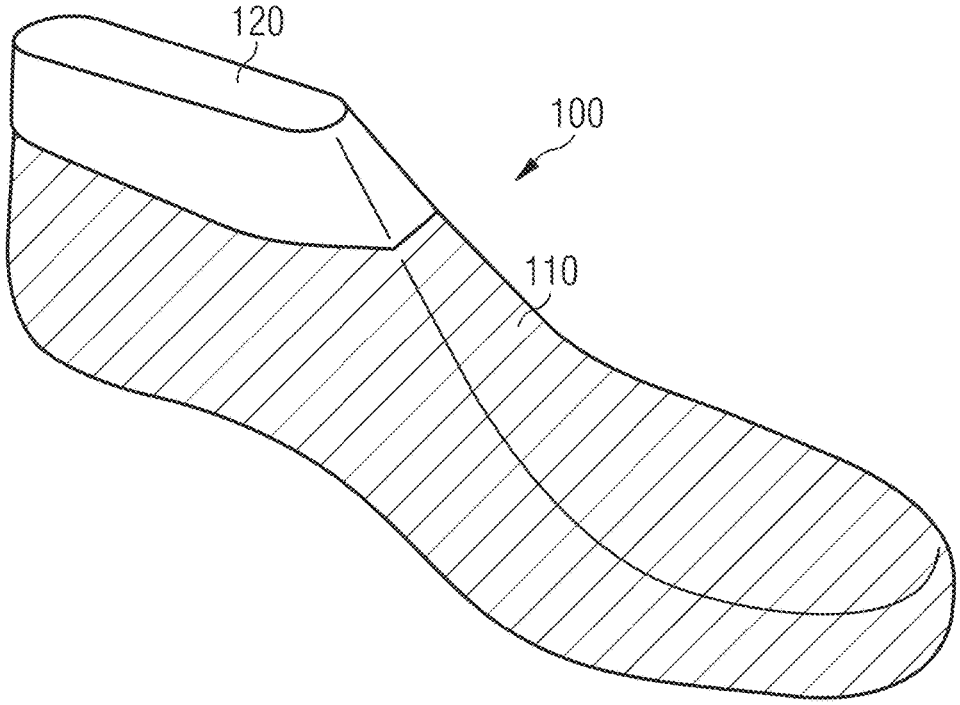
FIG. 1: embodiments schematically illustrating a textile layer having the shape of a three-dimensional upper for a shoe mounted on a last.

The above-mentioned problem is at least partly solved by the subject matter of the independent claims of the present invention. Exemplary embodiments of the invention are defined in the dependent claims.

In an embodiment, the present invention provides a method of coloring a textile layer comprising the steps of applying a first coating to the textile layer, wherein the first coating comprises a polyurethane. The method further comprises curing the first coating such that the first coating is transparent after the curing and applying a second coating to the cured first coating. The second coating comprises at least one coloring agent.

The claimed invention also provides a method, wherein the first coating may serve as a kind of primer layer to improve the bonding and/or adhesion of the second coating comprising a coloring agent to a textile substrate. In addition, the method may also prevent the second coating from soaking into the textile substrate, resulting in a brighter appearance of the coloring agent of the second coating.

In some embodiments the present invention provides a method, wherein a thickness of the first coating may be between 20 and 120 μm, between 40 and 110 μm, between 60 and 100 μm or between 80 and 95 μm after the curing. In this manner, the thickness of the primer layer may be thin enough to be transparent after curing so that an optical appearance of the textile layer may not be altered after application of the first coating. In addition, the inherent flexibility of such a thin layer of coating comprising polyurethane may also not reduce the flexibility of the textile layer, making it stiff. Thus, the application of the first coating before the second coating may not change the characteristics of the textile layer in a negative manner.

In some embodiments the present invention provides a method of curing which may comprise applying heat to the textile layer at a temperature between 20° C. and 150° C., between 40° C. and 130° C., between 60° C. and 110° C. or between 80° C. and 100° C. The curing may further comprise using an oven, a fan, a hot air blower, an infrared radiator, or combinations thereof.

In this manner it may be possible to remove an aqueous part of the first coating faster than compared to letting the first coating dry at room temperature. Moreover, some of the coatings may need to be exposed to a curing temperature above room temperature to develop their desirable properties. It may be noted that the temperature of the curing may be further adapted if applied to heat-sensitive textile materials.

In some embodiments, the curing may further comprise applying the heat to the textile layer for less than 60 min, less than 30 min, less than 15 min or less than 5 min. If possible, the duration of the heat application may be as short as possible while still maintaining a high quality cured first coating to speed up the manufacturing process and thus, making it more efficient.

In some embodiments the present invention provides a method wherein applying the first and/or second coating may comprise applying the first and/or second coating using a spray gun, a silicon pad or an ink-jet.

The method of application of the first and/or second coating may be adapted depending on the textile substrate and the used first and/or second coating material. In some embodiments, the first coating may be applied using a spray gun, which enables the creation of a fine spray mist. The spray mist may comprise many single droplets of the first coating, which may be able to reach any part of a surface of a substrate textile layer directed towards the spray gun, thereby covering each of the single yarns of the surface if envisaged.

This process may be particularly beneficial due to the use of polyurethane polymers in the first coating—polyurethane polymers comprise atoms of oxygen, hydrogen and/or nitrogen, and these atoms exhibit easy polarization making it possible to develop van-der-Waals forces between neighbouring polymers which also include polarized atom-groups. It may further be possible to build up hydrogen-bridges between such polymers, increasing the bonding strength within the polymers of the first coating. In some embodiments, only the part of the textile that is intended to be coated with a second coating may be previously covered with a first coating. In other embodiments, the total textile layer may be coated with the first coating and only a part of it may be additionally exposed to the second coating. The second coating may be applied by means of a spray gun, a silicon pad or an ink-jet.

In a further embodiment, only the first coating may be applied to the textile layer with increased thickness and the second coating may be partly or even completely omitted. The increased thickness may enhance the robustness of the textile layer to wear and tear, i.e. increase the abrasion resistance, and increase the lifecycle of products manufactured according to the methods of the present invention. It may be noted that such coating with only the first coating may also be applicable as kind of a pre-treatment to strengthen the textile layer in particular areas, which are intended for further processing such as bonding processes, cutting processes or similar. Moreover, if the application of the first and/or second coating is achieved by an automated process, regular cleaning of the application device may be necessary, such as wiping, intermediate spraying or others to ensure a high-quality resulting product.

In some embodiments the present invention provides a method of adapting a rheology of the first coating depending on a material of the textile layer. In other words, the consistency or viscosity of the first coating may be adapted for the specific textile it is being used on. A wide range of different consistencies may be achieved for the polyurethane first coating. Thus, it may be possible to adapt the rheology of the polyurethane first coating to suit the various kinds of substrate materials. Furthermore, an adaptation of the first coatings rheology with respect to a manufacturing technique of the textile layer such as for example knitted fabrics, woven fabrics, nonwovens or others may be possible.

In some embodiments the present invention provides a method, wherein the second coating may further comprise a polyurethane. It is known from the prior art that a large proportion of coatings commercially available for coloring textile layers are polyurethane-based. However, the inventors found out that applying such second coating comprising polyurethane and a coloring agent or an inherent colored polyurethane coating on top of a cured first coating also comprising polyurethane may provide various advantages as already described above. In addition, the above-mentioned development of hydrogen-bonds between polymers within the first coating may also facilitate the bonding between the first and the second coating layer. Chemical bonds at this level provide a significant advantage over the use of mechanical bonds only to adhere ink to a textile. Thus, the present invention may provide a method of improved adhesion of the second coating comprising at least one coloring agent to the textile layer by use of the first coating/primer layer.

In another aspect the present invention provides a textile layer comprising a first coating, wherein the first coating is a cured coating and comprises a polyurethane. The textile layer further comprises a second coating, wherein the second coating comprises at least one coloring agent and is arranged on the cured first coating. The polyurethane based cured first coating is transparent.

Therefore, the present invention may provide a textile layer with improved coloring. In particular, the textile layer of the present invention may comprise a brilliant and shiny appearance of the applied colors, due to the application of the first coating layer, which may prevent the second coating layer from soaking into the textile layer. In addition, the first coating may also act as an adherent layer between the textile layer and the second coating to improve the bonding of the coloring agent.

In some embodiments of the present invention, a thickness of the first coating may be between 20 and 120 μm, between 40 and 110 μm, between 60 and 100 μm or between 80 and 95 μm after the curing. Moreover, the first and/or second coating may have been applied using a spray gun, a silicon pad, an ink-jet or another known technique.

It may be appreciated that the above-mentioned methods may be applicable to conventional two-dimensional (2D) manufacture of textiles. In particular, in the manufacture of footwear using a flat vamp, the vamp while flat may be coated with the first and/or second coating in a flat position, before being formed into a 3D upper may be within the scope of the present invention. Furthermore, the provided methods may also be applicable in 3D manufacture of textiles. The first and/or second coating may be applied directly to a shaped textile. The textile does not have to be lying flat on a surface to be coated from above. The textile may be formed into a 3D shape and may be coated from the side or from underneath. This may be particularly desirable in the manufacture of footwear, wherein an upper of a shoe may be already formed about a last before application of the first and/or second coating.

In some embodiments of the present invention, a rheology of the first coating may have been adapted depending on a material of the textile layer. Furthermore, the rheology may have also been adapted depending on a manufacturing technique of the substrate textile layer, including for example knitted fabrics, woven fabrics, nonwovens or others.

In some embodiments the second coating may comprise a polyurethane. Therefore, an improved adhesion between the first and the second coating may be provided, which as a result may provide an improved attachment of the coloring agent to the textile layer.

It may be noted that the above-mentioned methods of coloring a textile layer may be applicable to various kinds of textiles, resulting in a textile layer according to the present invention. These textile layers may be used in the manufacturing of footwear.

Alternatively, these textile layers may be used in the manufacture of apparel. In conclusion, the present invention may provide a thin layer of polyurethane based first coating or primer as an improved moderator between a textile layer and a second coating comprising a coloring agent. In this manner, the adhesion of the ink on the textile layer and the shininess of the color may be enhanced immensely.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments of the present invention are described in more detail with reference to a textile layer, such as for example a textile layer for an upper of footwear. While specific feature combinations are described in the following with respect to exemplary embodiments of the present invention, it is to be understood that the disclosure is not limited to such embodiments. In particular, not all features have to be present for realizing the invention, and the embodiments may be modified by combining certain features of one embodiment with at least one feature of other embodiments.

FIG. 1 depicts an embodiment 100 of the present invention comprising a textile layer 110 having a shape of an upper formed around a last 120. The textile layer 110 may have been manufactured by knitting, weaving, may comprise a nonwoven fabric or a combination thereof. The textile layer 110 further comprises a thin first coating comprising a polyurethane, which after curing in an oven has a predetermined thickness and is transparent. The first coating has been applied using a spray gun (not shown) with a predefined rate of deposition. However, various other coating techniques like pad printing, using an ink-jet or a combination thereof may also be applicable. On top of the cured first coating, a second coating has been applied using the same coating technique as for the first coating (not shown). However, various other coating techniques like pad printing, using an ink-jet or a combination thereof, which may also differ from the coating technique of the first layer, may also be applicable. The second coating comprises a coloring agent. The resulting textile layer 110 may be further processed by trimming, attaching a sole to it or various further steps for finishing an intended product, such as a shoe (not shown). It may be appreciated that the textile layer 110 may not have to be formed about a last for the application of the first and/or second coating according to the present invention. The same or a similar process as described with reference to FIG. 1 may also be applicable to a flat textile layer, such as for example a flat vamp, prior to be formed into its intended 3D shape.

In another embodiment, no second coating comprising a coloring agent may have been applied to the textile layer 110, whereas the thickness of the first coating may have been increased up to 1.5 mm. In this manner, the first coating may be applied as a strengthening and/or protecting coating to, for example increase a wear and tear resistance of the textile layer 110, increase a water-repellence or simply increase the lifecycle of the finished textile layer 110.

Figure 2:
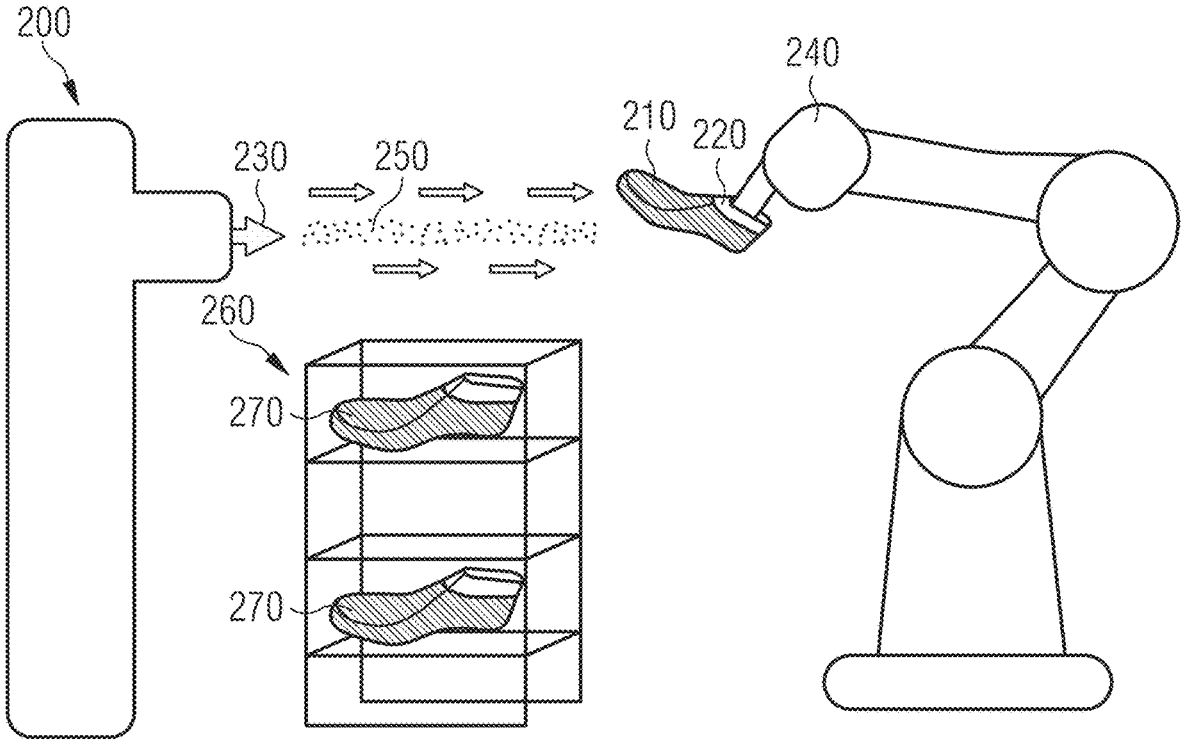
FIG. 2: an illustration of a coating process onto a three-dimensional upper mounted on a last, wherein the coating process is controlled via a robotic arm.

FIG. 2 depicts an exemplary coating process 200 of a textile layer 210 formed around a last 220. The textile layer 210 may be knitted, woven, nonwoven or any combination thereof. The illustrated coating process 200 may be fully automated by use of a robotic arm 240, to which the last 220 is attached. In a first step, the spray gun 230 applies a first coating material 250 comprising a polyurethane to the textile layer 210. The thickness of the first coating may be adjusted by an exposure time of the textile layer 210 to the fine spray mist of the first coating material 250. The exposure time and location on the textile layer 210 is controlled by a predetermined pathway of the robotic arm 240. The activation of the spray gun 230 may be controlled automatically. Furthermore, to ensure a high-quality coating layer, the spray gun 230 may automatically perform cleaning steps after a predefined time interval and/or a predefined amount of coating material sprayed. After completion of the first coating, the robotic arm guides the last 220 into a free slot of an oven 260 for curing. The duration and temperature of each slot of the oven 260 may be adjusted individually depending on the coating and/or on the material of the textile layer. If the curing duration of the textile layer 210 formed around the last 220 takes longer than a coating duration of another textile layer, the robot may perform the coating of another last, e.g. one of lasts 270, during the curing of the last 220. If the duration is shorter than the curing duration, the spray gun 230 may perform an intermediate cleaning cycle, a cleaning cycle for changing to another coating material or simply wait until the curing duration of the last 220 has expired. If the curing duration is significantly longer than the coating duration, multiple textile layers may be coated and positioned within the oven, and all of these textile layers may be cured simultaneously once the oven is full.

After the duration of the curing process has expired, the robotic arm 240 takes the last 220 out of the oven 260 and the spray gun 230 begins with an application of the second coating similar to the application of the first coating 250. The second coating is applied to the cured first coating on the textile layer 210. The second coating comprises at least one coloring agent. In some embodiments, the second coating may also comprise a polyurethane. Similar to the application of the first coating 250, the exposure time and location on the textile layer 210 during the application of the second coating may be fully controlled by the pathway of the robotic arm 240.

After completion of the second coating, the robotic arm 240 may place the last 240 onto a storage or resting slot (not shown), on which the second coating may dry and/or on which the textile layer 210 may wait for further finalizing steps, such as trimming, attaching the upper to a sole or similar. In an alternative embodiment, the robotic arm 240 may place the last 220 again into an oven 260, for curing of the second coating. The temperature and duration of the second curing may be identical or different from the first curing.

It may be noted, that the robotic arm 240 may also be used with various other techniques of coating, such as using a silicon pad, pad printing in general, an ink-jet or similar coating techniques. Further, the above-described process of applying the first and/or second coating and the possible curing may not be limited to be conducted by a single robotic arm. Instead, multiple robotic arms may be specifically adapted in working together, each conducting at least one single processing step, which reduces the time for conversion of a single robotic arm between various different processing steps, such as for example changing to another coating material. Moreover, the rheology of the first and/or second coating may be adapted prior to the coating process depending on a material of the textile layer, the coating technique, the thickness of the respective layer or a combination thereof.

It may be further noted, that despite the above presented embodiments of coloring a textile layer mainly relate to textile layers with respect to footwear, the same or very similar methods and techniques may also be applicable to various other kinds of products, such as items of apparel, resulting in a textile layer according to the present invention.

In the following, further examples are described to facilitate the understanding of the invention:

1. A method of coloring a textile layer (110, 210) comprising the steps of: applying a first coating (250) to the textile layer, wherein the first coating comprises a polyurethane; curing the first coating, such that the first coating is transparent after the curing; and applying a second coating to the cured first coating, wherein the second coating comprises at least one coloring agent.
2. The method according to example 1, wherein a thickness of the first coating is between 20 and 120 μm, between 40 and 110 μm, between 60 and 100 μm or between 80 and 95 μm after the curing.
3. The method according to example 1 or 2, wherein curing comprises applying heat to the textile layer between 20° C. and 150° C., between 40° C. and 130° C., between 60° C. and 110° C. or between 80° C. and 100° C.
4. The method according to one of examples 1 to 3, wherein the curing comprises using an oven (260), a fan, a hot air blower or an infrared radiator.
5. The method according to example 3 or 4, wherein the curing further comprises applying the heat to the textile layer for less than 60 min, less than 30 min, less than 15 min or less than 5 min.
6. The method according to one of examples 1 to 5, wherein the applying the first and/or second coating comprises applying the first and/or second coating using a spray gun (230), a silicon pad or an ink-jet.
7. The method according to one of examples 1 to 6 further comprises, adapting a rheology of the first coating depending on a material of the textile layer.
8. The method according to one of examples 1 to 7, wherein the second coating further comprises a polyurethane.
9. A textile layer (110, 210) comprising: a first coating (250), wherein the first coating is a cured coating and comprises a polyurethane; a second coating, wherein the second coating comprises at least one coloring agent and is arranged on the cured first coating; and wherein the polyurethane based cured first coating is transparent.
10. The textile layer according to example 9, wherein a thickness of the first coating is between 20 and 120 μm, between 40 and 110 μm, between 60 and 100 μm and or 80 and 95 μm after the curing.
11. The textile layer according to example 9 or 10, wherein the first and/or second coating has been applied using a spray gun (230), a silicon pad or an ink-jet.
12. The textile layer according to one of examples 9 to 11, wherein a rheology of the first coating has been adapted depending on a material of the textile layer.
13. The textile layer according to one of examples 9 to 12, wherein the second coating comprises a polyurethane.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method of coloring a textile layer comprising the steps of:

applying a first coating to the textile layer, wherein the first coating comprises a polyurethane;

curing the first coating, wherein the first coating is transparent after the curing; and applying a second coating to the cured first coating, wherein the second coating comprises at least one coloring agent; and wherein the second coating is arranged on top of the first coating.

2. The method according to claim 1, wherein a thickness of the first coating is between 20 and 120 μm after the curing.

3. The method according to claim 1, wherein a thickness of the first coating is between 40 and 110 μm after the curing.

4. The method according to claim 1, wherein a thickness of the first coating is between 80 and 95 μm after the curing.

5. The method according to claim 1, wherein curing comprises applying heat to the textile layer at a temperature between 20° C. and 150° C.

6. The method according to claim 1, wherein curing comprises applying heat to the textile layer at a temperature between 40° C. and 130° C.

7. The method according to claim 1, wherein curing comprises applying heat to the textile layer at a temperature between 60° C. and 110° C.

8. The method according to claim 1, wherein curing comprises applying heat to the textile layer at a temperature between 80° C. and 100° C.

9. The method according to claim 2, wherein the curing comprises using an oven, a fan, a hot air blower, an infrared radiator or combinations thereof.

10. The method according to claim 5, wherein the curing further comprises applying the heat to the textile layer for less than 60 minutes.

11. The method according to claim 1, wherein the applying the first and/or second coating comprises applying the first and/or second coating using a spray gun, a silicon pad or an ink-jet.

12. The method according to claim 1, wherein the method further comprises adapting a rheology of the first coating depending on a material of the textile layer.

13. The method according to claim 1, wherein the second coating further comprises a polyurethane.

14. A textile layer comprising:

a first coating, wherein the first coating is a cured first coating and comprises a polyurethane;

a second coating, wherein the second coating comprises at least one coloring agent and is arranged on top of the cured first coating; and wherein the cured first coating is transparent.

15. The textile layer according to claim 14, wherein a thickness of the first coating is between 20 and 120 μm after the curing.

16. The textile layer according to claim 14, wherein a thickness of the first coating is between 40 and 110 μm after the curing.

17. The textile layer according to claim 14, wherein a thickness of the first coating is between 80 and 95 μm after the curing.

18. The textile layer according to 14, wherein the first and/or second coating has been applied using a spray gun, a silicon pad or an ink-jet.

19. The textile layer according to claim 14, wherein a rheology of the first coating is adapted depending on a material of the textile layer.

20. The textile layer according to claim 14, wherein the second coating comprises a polyurethane.

* * * * *